US007969266B2

(12) United States Patent
Sano et al.

(10) Patent No.: US 7,969,266 B2
(45) Date of Patent: Jun. 28, 2011

(54) INDUCTOR

(75) Inventors: Kan Sano, Tokyo (JP); Yuichiro Urano, Tokyo (JP)

(73) Assignee: Sumida Corporation (JP)

( * ) Notice: Subject to any disclaimer, the term of this patent is extended or adjusted under 35 U.S.C. 154(b) by 24 days.

(21) Appl. No.: 12/524,333

(22) PCT Filed: Nov. 2, 2007

(86) PCT No.: PCT/JP2007/071394

§ 371 (c)(1),
(2), (4) Date: Jul. 23, 2009

(87) PCT Pub. No.: WO2008/090656

PCT Pub. Date: Jul. 31, 2008

(65) Prior Publication Data

US 2010/0109826 A1 May 6, 2010

(30) Foreign Application Priority Data

Jan. 24, 2007 (JP) ..... 2007-013857

(51) Int. Cl.

| | |
|---|---|
| ***H01F 27/06*** | (2006.01) |
| ***H01F 27/02*** | (2006.01) |
| ***H01F 21/06*** | (2006.01) |
| ***H01F 17/04*** | (2006.01) |
| ***H01F 27/30*** | (2006.01) |

(52) U.S. Cl. ..... 336/65; 336/83; 336/131; 336/132; 336/221; 336/196

(58) Field of Classification Search ..... None
See application file for complete search history.

(56) References Cited

U.S. PATENT DOCUMENTS

| | | | | |
|---|---|---|---|---|
| 4,172,964 | A * | 10/1979 | Reinebach | 178/46 |
| 2005/0104707 | A1 * | 5/2005 | Rothmayer et al. | 336/208 |

FOREIGN PATENT DOCUMENTS

| | | | |
|---|---|---|---|
| JP | 50-47161 | | 4/1975 |
| JP | 55-9818 | B2 | 3/1980 |
| JP | 61-8910 | A | 1/1986 |
| JP | 6-231975 | A | 8/1994 |
| JP | 8-186030 | A | 7/1996 |
| JP | 9-275015 | A | 10/1997 |
| JP | 2002-75743 | A | 3/2002 |
| JP | 2005-260130 | A * | 9/2005 |

OTHER PUBLICATIONS

International Search Report for International Application No. PCT/JP2007/071394 mailed Feb. 5, 2008 with English Translation.

* cited by examiner

*Primary Examiner* — Anh T Mai
*Assistant Examiner* — Mangtin Lian
(74) *Attorney, Agent, or Firm* — Cantor Colburn LLP

(57) ABSTRACT

Provided is an inductor capable of adjusting an inductance in dozens of nH increments without requiring a large number of components. The inductor includes: a conductor; a first core body and a second core body each having an opposed surface, the opposed surface of the first core body and the opposed surface of the second core body facing each other so as to enclose the conductor; and a holding part provided with a slide surface for varying an opposed area of the opposed surfaces of the first core body and the second core body, for holding at least one of the first core body and the second core body at a desired position.

2 Claims, 6 Drawing Sheets

INDUCTOR

CROSS REFERENCE TO RELATED APPLICATIONS

This is a U.S. national stage of application No. PCT/JP2007/071394, filed on 2 Nov. 2007. Priority under 35 U.S.C. §119(a) and 35 U.S.C. §365(b) is claimed from Japanese Application No. 2007-013857, filed 24 Jan. 2007, the disclosure of which is also incorporated herein by reference.

TECHNICAL FIELD

The present invention relates to an inductor.

RELATED ART

Generally, it is known that an inductor is provided with a gap in a magnetic flux path of a core member so as to adjust an amount of leakage magnetic flux in order to avoid rapid magnetic saturation when applying an electric current and to improve DC superposition characteristics. Further, there is such a correlation that, as the gap becomes larger, the leakage magnetic flux of the inductor increases whereas an inductance decreases, and that, as the gap becomes smaller, the leakage magnetic flux of the inductor decreases whereas the inductance increases.

An inductor disclosed in Patent Document 1 has a structure in which two E-shaped cores face each other and part of an intermediate leg of one core can be inserted into a hole formed to an intermediate leg of the other core. Further, by changing the inserting amount, the inductance can be adjusted. Also in Patent Documents 2 to 4, there are disclosed elements capable of adjusting a gap between two cores by a similar mechanism. Note that, the "E-shaped core" is a common name referring to a core in which outer legs are provided upright on both ends of a plate-shaped core member and an intermediate leg is provided upright between both the outer legs.

Patent Document 1: JP 06-231975 A
Patent Document 2: JP 08-186030 A
Patent Document 3: JP 09-275015 A
Patent Document 4: JP 2002-75743 A

DISCLOSURE OF THE INVENTION

Problem to be Solved by the Invention

Incidentally, an inductor mounted on a substrate of a display device or the like is required to delicately adjust the inductance in at least dozens of nH (nanohenry) increments. However, the inductors disclosed in Patent Documents 1 to 4 are configured to adjust the gap between the cores with screws, and hence there is a problem that adjustment of the inductance in dozens of nH increments cannot be achieved. Further, the inductors of this type has such a problem that there are required a member such as a bolt and a nut for clamping the cores, a spacer to be sandwiched between the cores, and the like, and the number of components is increased, thereby leading to an increase in cost.

The present invention has been made in view of the above-mentioned circumstances, and therefore has an object to provide an inductor capable of adjusting an inductance in dozens of nH increments without requiring a large number of components.

Means for Solving the Problems

An inductor according to a preferred mode of the present invention, is characterized by including: a conductor; a first core body and a second core body each having an opposed surface, the opposed surface of the first core body and the opposed surface of the second core body facing each other so as to enclose the conductor; and a holding part provided with a slide surface for varying an opposed area of the opposed surfaces of the first core body and the second core body, for holding at least one of the first core body and the second core body at a desired position. According to the present invention, the first core body is slid with respect to the second core body so as to vary the opposed area of the opposed surfaces of both the core bodies, whereby it is possible to easily adjust the inductance in dozens of nH increments.

In this mode, a spacer may be sandwiched between the opposed surface of the first core body and the opposed surface of the second core body. According to the present invention, after the distance between the opposed surfaces of the first core body and the second core body is secured by the spacer, to thereby roughly adjust the inductance, adjustment can be performed in dozens of nH increments by varying the opposed area.

Further, at least one of the first core body and the second core body may be an E-shaped core in which outer legs are provided upright on both ends of a plate-shaped core member and an intermediate leg is provided upright between both the outer legs, and the conductor may be enclosed by recessed portions formed between the outer legs and the intermediate leg. According to the present invention, leakage magnetic flux can be relatively decreased.

Advantage of the Invention

According to the present invention, it is possible to adjust an inductance in dozens of nH increments without requiring a large number of components.

DESCRIPTION OF REFERENCE NUMERALS

Figure 1:
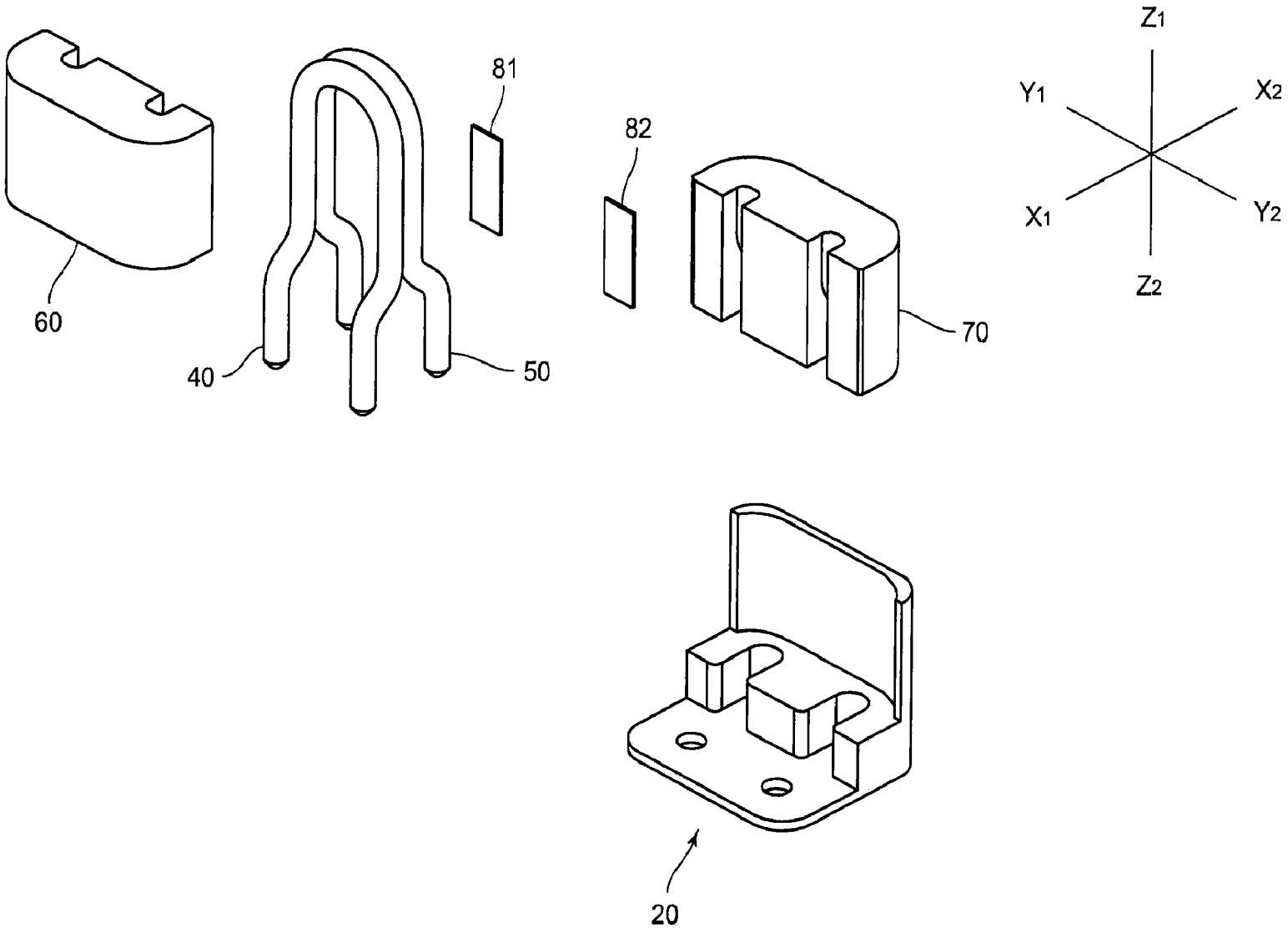
FIG. 1 is a perspective view of components constituting an inductor according to an embodiment.

10 inductor
20 base (corresponding to "holding part" of claims)
21 bottom plate part
22 back plate part
23 stepped part
24 hole
28, 29, 63, 64 groove
40 first conductive wire (corresponding to "conductor" of Claims)
41 upper curved portion
42 left leg portion
43 right leg portion
44 first bent portion
45 second bent portion

50 second conductive wire (corresponding to "conductor" of Claims)
60 first core
61 outer side surface
62 inner side surface (corresponding to "opposed surface" of Claims)
65 shallow groove
66 deep groove
70 second core
81, 82 spacer

BEST MODE FOR CARRYING OUT THE INVENTION

Embodiment of the Invention

In the following, an embodiment of the present invention is described with reference to the drawings.

Figure 2:
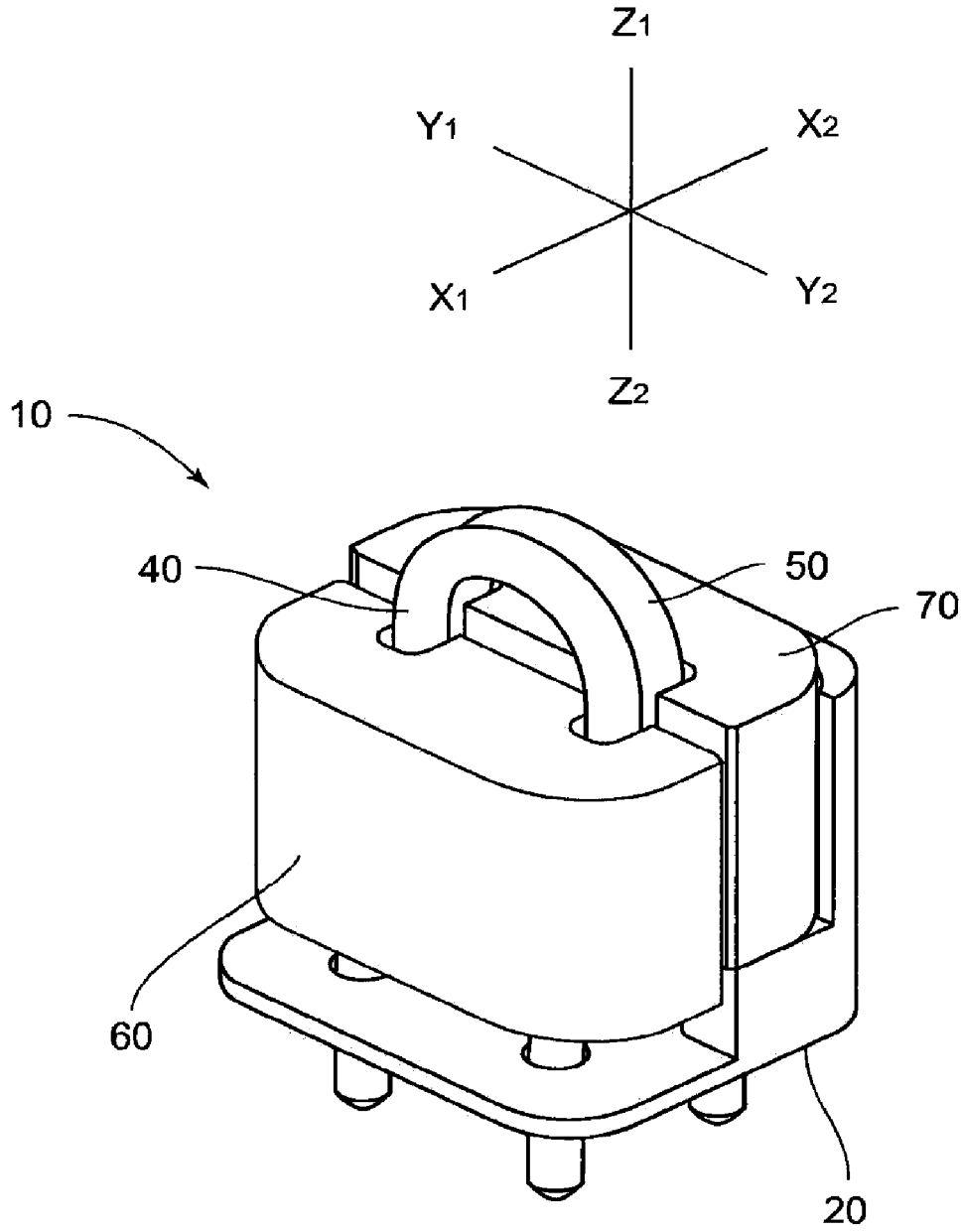
FIG. 2 is a perspective view of a finished product of the inductor according to the embodiment.

FIG. 1 is an exploded perspective view of components constituting an inductor 10 according to an embodiment of the present invention, and FIG. 2 is a perspective view of a finished product of the inductor 10 in which those components are assembled. Note that, in those figures, a direction oriented from X1 to X2 indicates a longitudinal direction, a direction oriented from Y1 to Y2 indicates a lateral direction, and a direction oriented from Z1 to Z2 indicates a vertical direction.

As illustrated in FIGS. 1 and 2, the inductor 10 has a base 20 (corresponding to "holding part" of Claims), a first conductive wire 40 (corresponding to "conductor" of Claims), a second conductive wire 50 (corresponding to "conductor" of Claims), a first core 60, a second core 70, and spacers 81, 82.

The base 20 is a member having a shape obtained by connecting together respective edge portions on one of sides of two flat plates so as to be orthogonal to each other and providing a stepped part inside the connected portion. The base 20 is made of a non-magnetic resin. However, as long as the base 20 is made of a non-magnetic material, any kind of material can be adopted. The first conductive wire 40 is a member having a shape obtained by bending a conductive wire into an inverted U-shape and further bending forward part of extending portions on both left and right sides of the bent portion. The structure of the second conductive wire 50 is the same as that of the first conductive wire 40. The second conductive wire 50 is retained on the base 20 in a state in which its longitudinal direction is opposite to that of the first conductive wire 40, that is, in a state in which part of extending portions are bent rearward.

The first core 60 is an E-shaped core. The E-shaped core is a core in which outer legs are provided upright on both ends of a plate-shaped core member and an intermediate leg is provided upright between both the outer legs. The structure of the second core 70 is the same as that of the first core 60. The second core 70 is retained on the base 20 in a state in which its X1-X2 direction is opposite to that of the first core 60, and the second core 70 faces the first core 60. Further, the first conductive wire 40, the second conductive wire 50, and the spacers 81, 82 are sandwiched between the cores 60, 70.

Figure 3A:
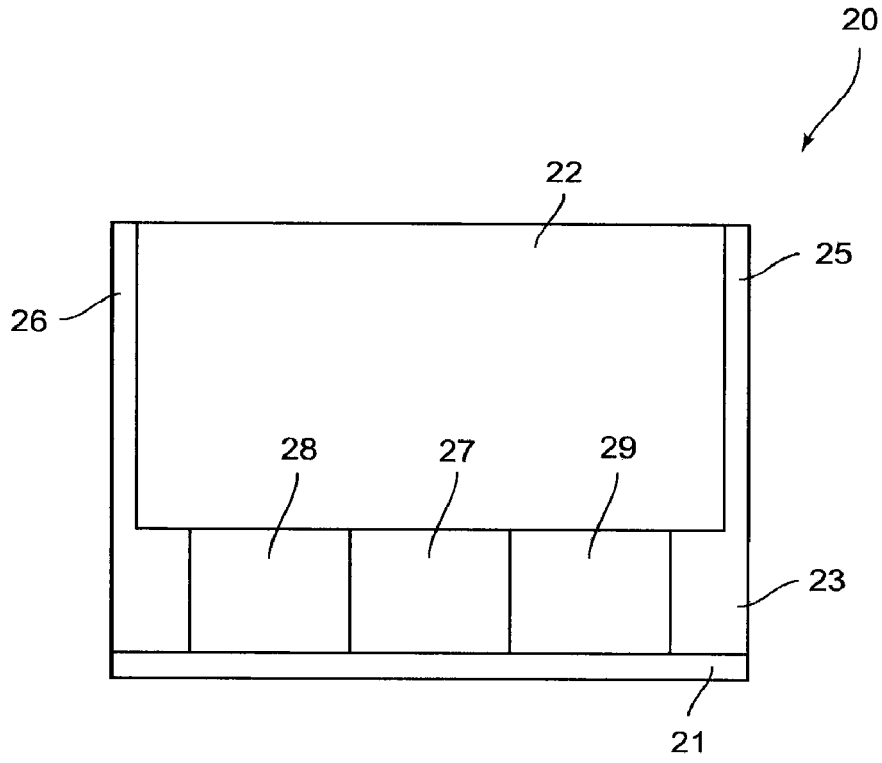
FIGS. 3A and 3B are a front view and a top view of a base, respectively.
Figure 3B:
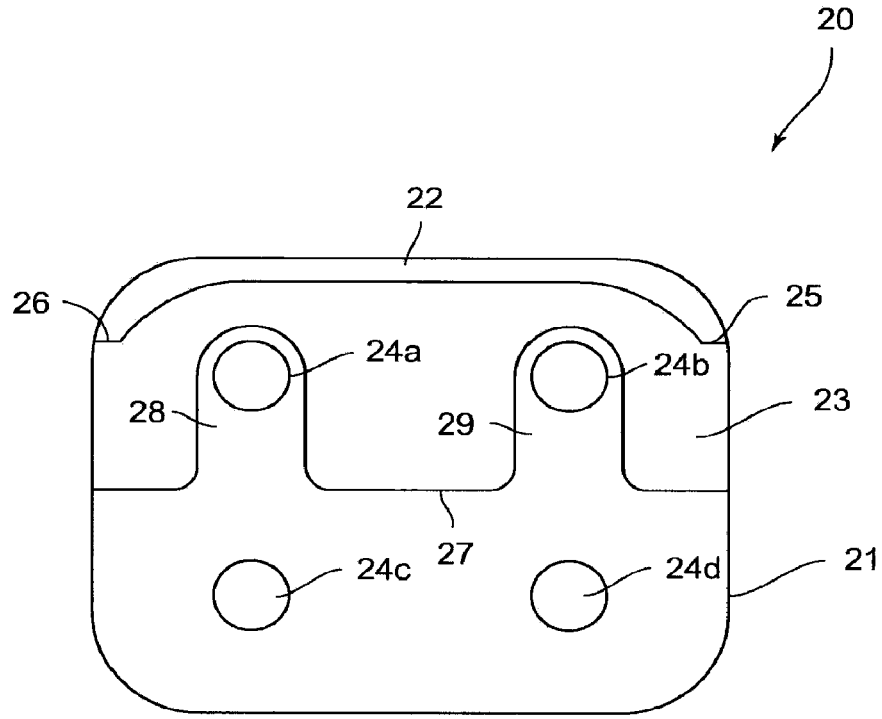

Those components are further described in detail. FIG. 3A is a front view of the base 20 taken in the X1 direction. FIG. 3B is a top view of the base 20 taken in the Z1 direction. The base 20 has a bottom plate part 21, a back plate part 22, and a stepped part 23. The bottom plate part 21 has a plate-like shape obtained by trimming in a rounding manner each boundary between adjacent side surfaces of four side surfaces interposed between its upper surface and lower surface, and four holes 24*a* to 24*d* are passed through the upper surface and the lower surface. As illustrated in FIG. 3B, the holes 24*a* to 24*d* are provided to have such a positional relation that the holes 24*a* to 24*d* correspond to corners of a rectangle.

The back plate part 22 is provided at the rear end side of the bottom plate part 21. The back plate part 22 has a shape obtained by curving forward, in conformity to the shape of the rear end side of the bottom plate part 21, a portion extending from both left and right ends 25, 26 of the flat plate to near the center on the inner side of the back plate part 22. The stepped part 23 has a shape obtained by causing to protrude upward as it is the rear side (rear half) of the bottom plate part 21 with respect to a line segment which is drawn so as to have an equal distance from the front end side and the rear end side of the upper surface of the bottom plate part 21, and recessing a front surface 27 formed by the protrusion rearward at two points so as to provide grooves 28, 29.

As illustrated in FIG. 3B, both the grooves 28, 29 of the stepped part 23 are provided to have the same interval as that between the two holes 24*a*, 24*b* on the rear side of the bottom plate part 21. Further, the grooves 28, 29 extend slightly behind both the holes 24*a*, 24*b*, and are opened toward the upper side of holes 24*a*, 24*b*. Further, as illustrated in FIG. 3A, in this embodiment, the height of the stepped part 23 in the Z1-Z2 direction is approximately one-third the height of the back plate part 22 in the Z1-Z2 direction.

Figure 4A:
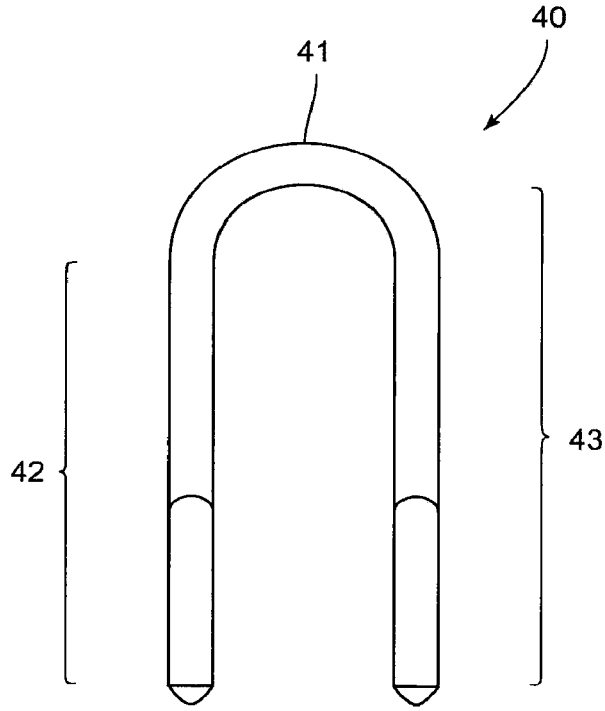
FIGS. 4A and 4B are a front view and a right-hand side view of a first conductive wire, respectively.
Figure 4B:
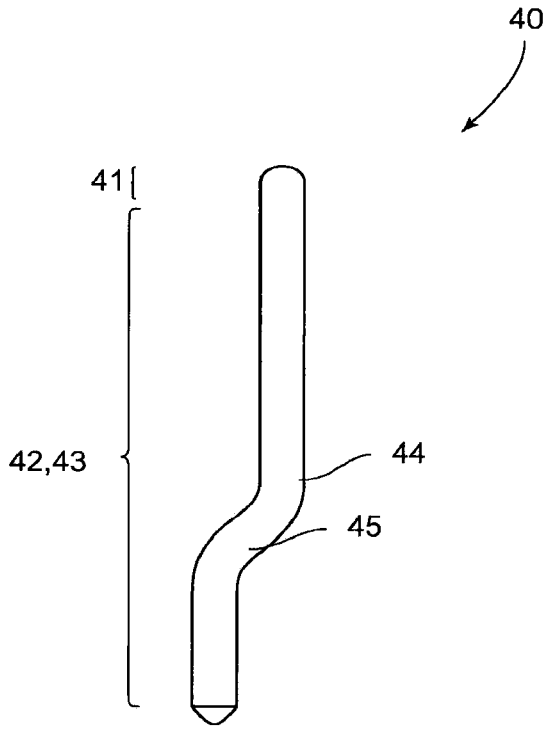

FIG. 4A is a front view of the first conductive wire 40 taken in the X1 direction, and FIG. 4B is a right-hand side view of the first conductive wire 40 taken in the Y2 direction. The first conductive wire 40 is made of copper, which is one kind of conductive metals, and its surface is covered with an insulating film such as enamel. As described above, the first conductive wire 40 has the shape obtained by bending a conductive wire into an inverted U-shape and further bending forward part of extending portions on both left and right sides of the bent portion. In the following, the portion of the first conductive wire 40 bent into an inverted U-shape is referred to as an "upper curved portion 41". Further, the lower portion with respect to the left end of the upper curved portion 41 is referred to as a "left leg portion 42", and the lower portion with respect to the right end thereof is referred to as a "right leg portion 43".

The upper curved portion 41 is bent so that the distance between the left end and right end thereof (diameter of curvature) is equal to the distance in width between both the grooves 28, 29 of the stepped part 23. The left leg portion 42 and the right leg portion 43 extend from both ends of the upper curved portion 41 in the Z2 direction. Further, each of the left leg portion 42 and the right leg portion 43 bend at a first bent portion 44 in a direction approximately intermediate between the X1 and Z2 vectors, and extend in the direction. In addition, each of the left leg portion 42 and the right leg portion 43 bend again at a second bent portion 45 in the Z2 direction, and extend in the direction. The distance from each of the left and right ends of the upper curved portion 41 to the first bent portion 44 is approximately the same as the height from the upper surface of the stepped part 23 of the base 20 to the upper end of the back plate part 22. Further, the distance from the first bent portion 44 to the second bent portion 45 is approximately the same as the distance from the upper surface of the bottom plate part 21 of the base 20 to the upper surface of the stepped part 23.

Figure 5A:
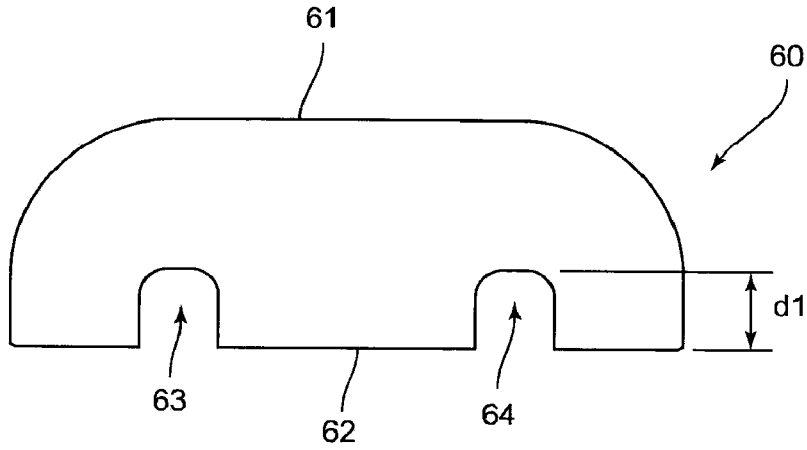
FIGS. 5A, 5B, and 5C are a top view, a right-hand side view, and a bottom view of a first core, respectively.
Figure 5B:
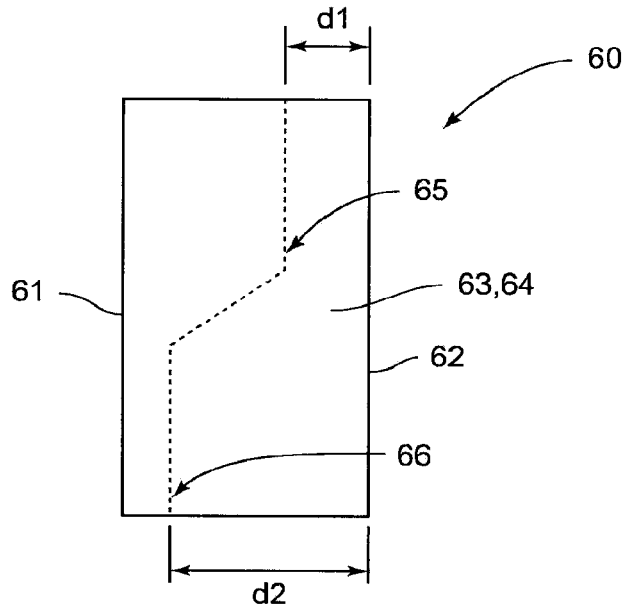
Figure 5C:
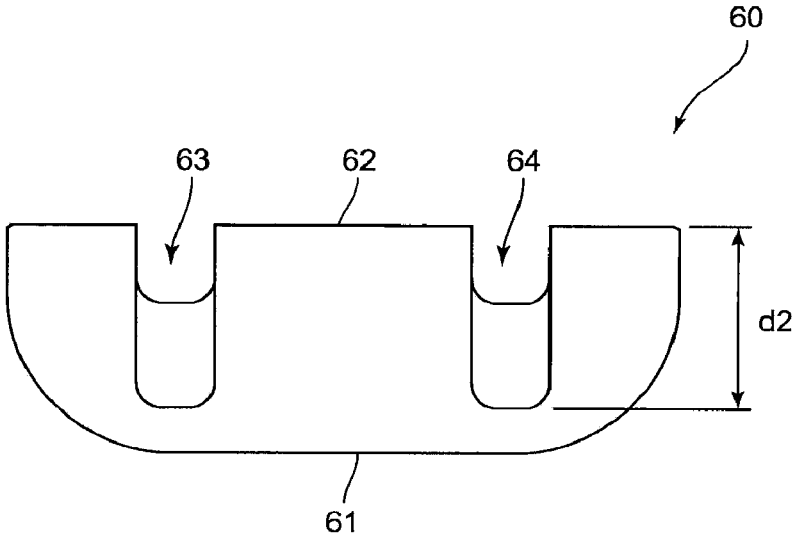

FIG. 5A is a top view of the first core 60 taken in the Z1 direction. FIG. 5B is a right-hand side view of the first core 60 taken in the Y2 direction. FIG. 5C is a bottom view of the first core 60 taken in the Z2 direction. The first core 60 is made of a Mn-based ferrite. Further, the first core 60 has a shape obtained by trimming in a rounding manner boundaries between one surface (surface viewed from the X1-X2 direction in FIG. 1) of a rectangular parallelepiped and both left and right surfaces each sharing one side with the one surface, and by providing two grooves 63, 64 extending in the vertical direction on the surface opposite to the one surface. In the following, the surface having the rounded boundaries with both the left and right surfaces is referred to as an "outer side surface 61", and the surface opposite thereto is referred to as an "inner side surface 62". The inner side surface 62 corresponds to an "opposed surface" of Claims.

Both the grooves 63, 64 of the inner side surface 62 are connected to have the same interval as that between the two holes 24*c*, 24*d* on the front side of the bottom plate part 21. Further, as illustrated in FIG. 5A, a depth d1 of both the grooves 63, 64 on the upper surface side of the first core 60 is approximately the same as the diameter of the first conductive wire 40. Meanwhile, as illustrated in FIG. 5C, a depth d2 of both the grooves 63, 64 on the lower surface side of the first core 60 is greater than the depth d1 (d1<d2), and is approximately the same as the depth of the grooves 28, 29 of the stepped part 23. FIG. 5B is illustrated by the dashed line the deepest portion, which is situated on the most X1 side, of the internal grooves 63, 64 when the first core 60 is viewed from the right-hand side. As illustrated in FIG. 5B, from the upper surface portion of the first core 60, shallow grooves 65 having approximately the same depth d1 as the diameter of the first conductive wire 40 extend toward the lower surface portion thereof. Meanwhile, from the lower surface portion, deep grooves 66 having approximately the same depth d2 as the depth of the grooves 28, 29 of the stepped part 23 extend toward the upper surface portion. Further, the shallow grooves 65 extend by approximately the same distance as that between the upper curved portion 41 and the first bent portion 44, and gradually increase in depth from the above-mentioned position to the upper ends of the deep grooves 66.

The spacers 81, 82 illustrated in FIG. 1 are components for roughly adjusting an inductance of the inductor 10, and the spacers 81, 82 are desirable to be plate bodies having a width of approximately 0.1 mm to 0.3 mm. While the material for the spacers 81, 82 is a non-magnetic resin or the like, a material having magnetic permeability greatly different from that of the first core 60 and the second core 70 may be used as the material for the spacers 81, 82.

Figure 6A:
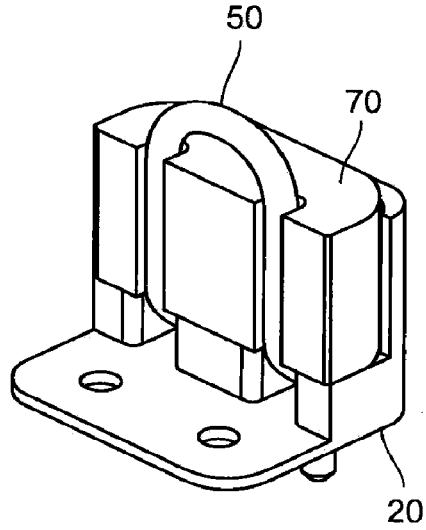
FIGS. 6A, 6B, and 6C are views illustrating an assembly process of the inductor.
Figure 6B:
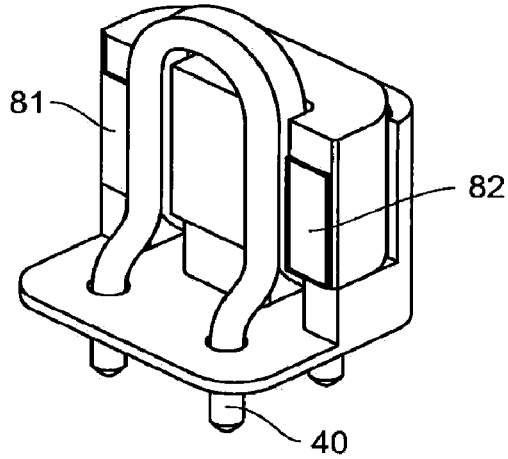
Figure 6C:
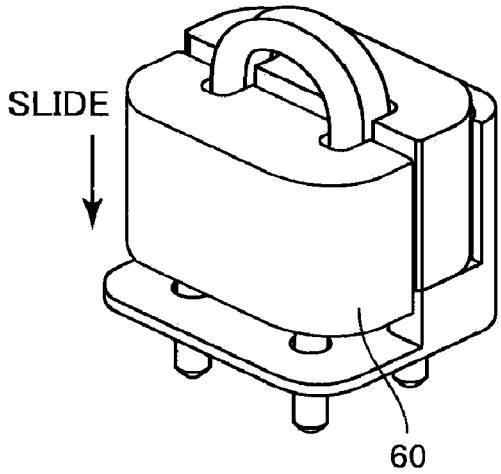

With reference to FIG. 6, there is described a procedure of assembling those components so as to obtain the finished product of the inductor 10 illustrated in FIG. 1. First, the left leg portion 42 and the right leg portion 43 of the second conductive wire 50 are accommodated in both the grooves 63, 64 of the second core 70 so as to expose the upper curved portion 41 from the upper surface side. Before or after this procedure, an adhesive is applied to the upper surface of the stepped part 23 of the base 20 and the front surface of the back plate part 22 thereof. Further, the lower ends of the left leg portion 42 and the right leg portion 43 of the second conductive wire 50 accommodated in the second core 70 are respectively inserted into the holes 24*a*, 24*b* on the rear side of the bottom plate part 21 of the base 20, and the lower surface and the outer side surface 61 of the second core 70 are pressed against the stepped part 23 and the back plate part 22, respectively. Both the upper surface of the base 20 and the lower surface of the second core 70 are flat, and the outer side surface 61 of the second core 70 is curved in the same shape as that of the front surface of the back plate part 22. Therefore, both the upper surface and the lower surface are bonded to each other with the adhesive, and the second core 70 is retained in the base 20 (see FIG. 6A).

Next, the spacers 81, 82 are placed on portions outside the grooves 63, 64 of the inner side surface 62 of the second core 70, respectively. Before or after this procedure, the lower ends of the left leg portion 42 and the right leg portion 43 of the first conductive wire 40 are respectively inserted into the holes 24*c*, 24*d* on the front side of the bottom plate part 21 of the base 20 (see FIG. 6B).

In addition, the left leg portion 42 and the right leg portion 43 of the first conductive wire 40 are enclosed by the first core 60 so as to be accommodated in the grooves 63, 64 thereof, whereby the first conductive wire 40, the second conductive wire 50, and the spacers 81, 82 are sandwiched by the first core 60 and the second core 70. Further, according to need, the first core 60 is slid toward the bottom plate part 21 of the base 20 (see FIG. 6C). That is, opposed surfaces of the first core 60 and the second core 70, which should be overlapped with each other completely in an opposed state under normal circumstances, are shifted by the dimension according to need, whereby the opposed area thereof is reduced.

With this, the inductance is adjusted in dozens of nH increments. Further, the distance between the inner side surface 62 and the outer side surface 61 of the second core 70 is the same as or larger than the distance from the rear end of the upper surface of the stepped part 23 of the base 20 to the front end thereof. Therefore, the inner side surface 62 of the first core 60, which extends downward with respect to the second core 70, is opposed to the front surface 27 of the stepped part 23, and the lower surface of the first core 60 is slid until it is brought into contact with the bottom plate part 21 of the base 20, whereby the inductance can be adjusted. When, owing to the sliding, the distance between the lower surface of the first core 60 and the bottom plate part 21 of the base 20 reaches an ideal value, the sliding operation is stopped, and the adhesive is applied to the first core 60 and the second core 70 from above and the left and right sides thereof, whereby both the cores are bonded to each other as they are. With the procedure as described above, the inductor 10 illustrated in FIG. 2 is completed.

In the above-mentioned inductor 10 according to this embodiment, the first core 60 is slid with respect to the second core 70 so as to vary the opposed area of the inner side surfaces 62 of the cores, whereby the inductance can be adjusted in dozens of nH increments. Moreover, such delicate adjustment can be performed without using screws, and hence it is unnecessary to mount extra components which are unessential in view of the original purpose of the inductor 10, whereby it is possible to suppress its manufacturing cost. Further, the spacers 81, 82 are sandwiched between the first core 60 and the second core 70. Therefore, the distance between the first core 60 and the second core 70 is secured by the width of the spacers 81, 82, and the inductance can be adjusted roughly. Further, both the first core 60 and the second core 70 are E-shaped cores. Thus, by combining both the cores with each other, it is possible to form a closed magnetic path type core in which leakage magnetic flux is relatively decreased.

Another Embodiment

The present invention is not limited to the above-mentioned embodiment, and various modifications can be adopted.

While, in the above-mentioned embodiment, the first conductive wire 40 and the second conductive wire 50 are made of copper, they may be made of other conductors such as stainless steel, aluminum, and iron.

While, in the above-mentioned embodiment, the base 20, the first core 60, and the second core 70 are made of a Mn-based ferrite, they may be made of other magnetic materials such as permalloy, sendust, iron, and carbonyl. Further, the first core 60 and the second core 70 may be made of different materials from each other.

In the inductor 10 according to the above-mentioned embodiment, the first conductive wire 40 and the second conductive wire 50 are enclosed by the grooves of the first core 60 and the second core 70. However, the number of the conductive wires enclosed by the cores is not limited to two. One or three or more conductive wires may be enclosed by both the cores. Further, the present invention is not limited to the case where the inductor 10 is constituted by the first core 60 and the second core 70, namely two E-shaped cores. For example, the conductive wires are inserted into recessed portions formed between two outer legs and an intermediate leg of an E-shaped core, and bonding is performed while those legs face an I-shaped core, whereby the inductor 10 may be formed. Further, instead of the E-shaped core, there may be used a U-shaped core having only one groove formed on substantially the center thereof.

The inductor 10 according to the above-mentioned embodiment is configured so as to slide the first core 60 in the vertical direction, that is, in the extending direction of the grooves 28, 29. Meanwhile, the inductance may be adjusted by sliding the first core 60 not in the vertical direction but in the lateral direction. In short, in the assembly process of the inductor 10, as long as one of the cores (first core 60 or second core 70) can be slid in a predetermined direction in a state in which the opposed surfaces of the two cores are approximately completely overlapped with each other, the sliding direction thereof does not matter. However, when taking a product size into consideration, by sliding the first core 60 upward and in the lateral direction, the height and width in the product size are changed, and hence it is desirable to slide the first core 60 downward. Further, in a state in which the opposed surfaces of the two cores are shifted from each other to some extent, the inductor 10 may be assembled so as to slide the first core 60 in a direction of increasing a shifting amount, or may be assembled so as to slide the first core 60 in a direction of decreasing the shifting amount. In this case, in the base 20, there may be formed a guide for sliding the first core 60 in the vertical and lateral directions. With this, the first core 60 can be easily slid.

In the inductor 10 according to the above-mentioned embodiment, the spacers 81, 82 are sandwiched between the first core 60 and the second core 70. Accordingly, after the inductance is roughly adjusted, further delicate adjustment can be performed by sliding the first core 60. Meanwhile, it is unessential to sandwich spacers 81, 82 between the first core 60 and the second core 70, and the distance between the first core 60 and the second core 70 may be secured by another member.

INDUSTRIAL APPLICABILITY

The inductor of the present invention can be used in a field of electrical apparatuses.

The invention claimed is:

1. An inductor, comprising:

a conductor;

a first core body and a second core body each having an opposed surface, the opposed surface of the first core body and the opposed surface of the second core body facing each other so as to enclose the conductor; and a holding part provided with a slide surface for varying an opposed area of the opposed surfaces of the first core body and the second core body, for holding at least one of the first core body and the second core body at a desired position;

wherein at least one of the first core body and the second core body is an E-shaped core in which outer legs are provided upright on both ends of a plate-shaped core member and an intermediate leg is provided upright between both the outer legs; and the conductor is enclosed by recessed portions formed between the outer legs and the intermediate leg and facing the opposed surface.

2. An inductor according to claim 1, wherein a spacer is sandwiched between the opposed surface of the first core body and the opposed surface of the second core body.

* * * * *